US011136525B2

(12) United States Patent
Berman et al.

(10) Patent No.: US 11,136,525 B2
(45) Date of Patent: Oct. 5, 2021

(54) LIQUID AND SEMISOLID LUBRICANT COMPOSITIONS, METHODS OF MAKING, AND USES THEREOF

(71) Applicants: UNIVERSITY OF NORTH TEXAS, Denton, TX (US); BOARD OF REGENTS OF THE UNIVERSITY OF NEBRASKA, Lincoln, NE (US); INDIANA UNIVERSITY RESEARCH AND TECHNOLOGY CORPORATION, Indianapolis, IN (US); HUAZHONG AGRICULUTRUAL UNIVERSITY, Wuhan (CN)

(72) Inventors: Diana Berman, Denton, TX (US); Kent Dean Chapman, Denton, TX (US); Tervor Bradley Romsdahl, Denton, TX (US); Edgar Benjamin Cahoon, Lincoln, NE (US); Robert Earl Minto, Indianapolis, IN (US); Chunyu Zhang, Wuhan (CN)

(73) Assignees: University of North Texas, Denton, TX (US); Board of Regents of the University of Nebraska, Lincoln, NE (US); Indiana University Research and Technology Corp, Indianapolis, IN (US); Huazhong Agricultural University, Wuhan (CN)

( * ) Notice: Subject to any disclaimer, the term of this patent is extended or adjusted under 35 U.S.C. 154(b) by 0 days.

(21) Appl. No.: 16/772,110

(22) PCT Filed: Dec. 14, 2018

(86) PCT No.: PCT/US2018/065718
§ 371 (c)(1),
(2) Date: Jun. 11, 2020

(87) PCT Pub. No.: WO2019/118860
PCT Pub. Date: Jun. 20, 2019

(65) Prior Publication Data
US 2021/0079312 A1 Mar. 18, 2021

Related U.S. Application Data

(60) Provisional application No. 62/598,624, filed on Dec. 14, 2017.

(51) Int. Cl.
*C10M 169/00* (2006.01)
*C10M 105/40* (2006.01)
(Continued)

(52) U.S. Cl.
CPC ..... *C10M 169/00* (2013.01); *C10M 105/40* (2013.01); *C10M 109/02* (2013.01);
(Continued)

(58) Field of Classification Search
CPC ..... C10M 169/02; C10M 105/36; C10M 117/04; C10M 169/06; C10M 135/06;
(Continued)

(56) References Cited

U.S. PATENT DOCUMENTS

| | | | |
|---|---|---|---|
| 5,458,795 | A | 10/1995 | Lawate |
| 5,792,729 | A | 8/1998 | Harrison et al. |
| 2012/0322707 | A1 | 12/2012 | Bredsguard et al. |

OTHER PUBLICATIONS

Wang et al., *Orychophragmus violaceus* L., a marginal land-based plant for biodiesel feedstock: Heterogeneous catalysis, fuel properties, and potential, Energy Conversion and Management, vol. 84, May 16, 2014, pp. 497-502.

(Continued)

*Primary Examiner* — Vishal V Vasisth
(74) *Attorney, Agent, or Firm* — Thomas | Horstemeyer, LLP

(57) ABSTRACT

Various liquid and semisolid lubricant compositions are provided, in particular lubricant compositions containing oil from the seeds of the Brassicaceae *Orychophragmus violaceus*, preferably those that have been esterified with one or (Continued)

more fatty acids such as palmitoleic acid, oleic acid, linoleic acid, lauric acid, palmitic acid, stearic acid, or a combination thereof. In various aspects, lubricant compositions are provided that include a petroleum or a synthetic base oil and about 40% or less by weight of a liquid lubricant composition containing oil from the seeds of the Brassicaceae *Orychophragmus violaceus*, preferably those that have been esterified with one or more fatty acids. In various aspects, semisolid lubricant composition are provided containing an emulsion of (i) a thickener and (ii) an oil from the seeds of the Brassicaceae *Orychophragmus violaceus*, preferably those that have been esterified with one or more fatty acids.

20 Claims, 12 Drawing Sheets

(51) Int. Cl.

| | |
|---|---|
| ***C10M 109/02*** | (2006.01) |
| ***C10M 117/04*** | (2006.01) |
| ***C10M 119/20*** | (2006.01) |
| *C10N 30/02* | (2006.01) |
| *C10N 30/04* | (2006.01) |
| *C10N 30/06* | (2006.01) |
| *C10N 30/10* | (2006.01) |
| *C10N 30/12* | (2006.01) |
| *C10N 30/14* | (2006.01) |
| *C10N 50/10* | (2006.01) |

(52) U.S. Cl.
CPC ..... *C10M 117/04* (2013.01); *C10M 119/20* (2013.01); *C10M 2207/1265* (2013.01); *C10M 2207/1285* (2013.01); *C10M 2207/2835* (2013.01); *C10M 2207/401* (2013.01); *C10M 2209/126* (2013.01); *C10N 2030/02* (2013.01); *C10N 2030/04* (2013.01); *C10N 2030/06* (2013.01); *C10N 2030/10* (2013.01); *C10N 2030/12* (2013.01); *C10N 2030/14* (2013.01); *C10N 2050/10* (2013.01)

(58) Field of Classification Search
CPC ..... C10N 2030/06; C10N 2030/02; C10N 2030/14; C10N 2030/04; C10N 2050/10; C10N 2030/10; C10N 2030/12
See application file for complete search history.

(56) References Cited

OTHER PUBLICATIONS

International Search Report for PCT/US2018/065718 dated Feb. 25, 2019.
International Search Report for PCT/US2018/065718 dated Mar. 22, 2019.

LIQUID AND SEMISOLID LUBRICANT COMPOSITIONS, METHODS OF MAKING, AND USES THEREOF

CROSS-REFERENCE TO RELATED APPLICATIONS

This application is the 35 U.S.C. § 371 national stage application of PCT Application No. PCT/US2018/065718, filed Dec. 14, 2018, where the PCT claims priority to, and the benefit of, U.S. provisional patent no. 62/598,624 filed Dec. 14, 2017, both of which are herein incorporated by reference in their entireties.

STATEMENT REGARDING FEDERALLY SPONSORED RESEARCH OR DEVELOPMENT

This invention was made with government support under award IOS1339385 and 0919938 awarded by the National Science Foundation. The government has certain rights in the invention.

TECHNICAL FIELD

The present disclosure generally relates to lubricant compositions.

BACKGROUND

Increasing transportation and other industrial activities since the beginning of the last century have consumed much of our non-renewable energy resources (like petroleum) day by day, and a significant portion of the energy produced is spent overcoming friction in moving mechanical systems.[4, 2] Sliding, rolling, or rotating contact interfaces in every manmade, natural or biological system generate friction. If not reduced or controlled effectively, high friction often leads to higher wear losses and, hence, shorter life and poor reliability.[5]

Consequently, friction has been one of the most active fields of study. Many researchers are still working to understand the root causes of friction and new ways to nearly eliminate it to achieve much higher efficiency and longer durability in all types of moving mechanical systems.[6,7]

One of the most effective ways of controlling friction is to use a lubricant in liquid, solid, and/or semisolid (grease) forms.[8] Lubricants reduce friction by preventing sliding contact interfaces from severe or more frequent metal-to-metal contacts or by forming a low-shear, high-durability boundary film on rubbing surfaces.[9] For example, depending on the sliding speed and other operating conditions, engine oils can effectively separate the contacting surfaces of rings and liners and, thereby, reduce the frequency of direct metal-to-metal contact and thus friction and wear.[6]

The petroleum industry offers many lubricants capable of working at customer-specified conditions. While being effective from the lubricative standpoint, synthetic oils and their derivatives are not appropriate for a range of bio-friendly applications (food and medical industry) and lead to adverse impact on the environment.[10]

Castor is one of the oldest cultivated crops for vegetable oil production.[11] Castor oil is the only major source of a hydroxylated fatty acid, which makes its production extremely important to the global chemical industry. Compared to standard lubricants, castor oil demonstrates higher viscosity, density, thermal conductivity, and pour point values. Castor oil has also been suggested as a base oil for making 100% biodegradable greases, oleogels.[12,13]

Anticipated demand of castor oil in many applications, from soaps to brake fluid to paints, and specifically in greases, requires increased production. The major concern is safety of growing castor plants and extracting oil for the seeds.[14, 15] Allergenic compounds on the castor plant surfaces as well as toxic byproducts from castor oil production (ricin) are the major causes of risk to human health.[16]

There remains a need for improved lubricant compositions that overcome the aforementioned deficiencies.

SUMMARY

An improved alternative for castor oil has been developed. Though castor oil is actively used in many lubricant applications, challenges associated with its processing increase the need for a safer and more effective substitute. Oil from the seeds of the Brassicaceae *Orychophragmus violaceus* (Chinese violet cress, February orchid) plant can be used in a variety of lubricant compositions with several beneficial advantages. Brassicaceae *Orychophragmus violaceus* seed oil (Chinese violet seed oil or "Ov oil") makes unusual long chain dihydroxy fatty acids for its seed oil. The fatty acids incorporated into triacylglycerols are 7,18-diOH $C_{24}$ with one or two double bonds. This is different from the hydroxy fatty acids in castor oil, which are shorter chain and contain only one hydroxyl moiety. Ov oil acids also form estolides, a chemical feature that has been reported to demonstrate excellent lubricant properties.[17,18] The number of esterified fatty acids branching from the two hydroxyl moieties within each acyl chain could result in a larger polymer and is likely responsible for the added viscosity of the Ov oil compared to castor oil. The number of acyl moieties was determined by electrospray ionization coupled to tandem mass spectrometry (ESI-MS/MS), and confirmed the presence of up to four linked dihydroxy long-chain fatty acids.

In some aspects, the present disclosure is directed to lubricant compositions. The lubricant compositions can be liquid or semi-solid lubricant compositions. The lubricant compositions can include oil from the seeds of the Brassicaceae *Orychophragmus violaceus*. The oil can be extracted, extruded, or pressed in various aspects. The lubricant compositions can include an oil having a mixture of triacylglycerols of 7,18-diOH $C_{24}$ fatty acids and estolides thereof. In some aspects, the oil is esterified with one or more fatty acids, e.g. of palmitoleic acid, oleic acid, linoleic acid, lauric acid, palmitic acid, stearic acid, or a combination thereof. In some aspects, the oil is esterified with one or more C 24:2 (OH)2 and C24:1 (OH2) fatty acids. In some aspects, the estolides are capped, i.e. containing a non-hydroxlated fatty acid. In some aspects, the estolides are uncapped, i.e. containing a di-dhydroxy fatty acid.

In various aspects, the lubricant compositions include one or more additives. Additives can be oil additives and/or grease additives. In various aspects, the additives are antioxidant such as (+)-α-tocopherol (TCP), propyl gallate (PG), I-ascorbic acid 6-palmitate (AP), 4,4'-methylenebis(2,6-di-tert-butylphenol) (MBP), butylated hydroxyl anisole (BHA), butylated hydroxyl toluene (BHT), propyl gallate (PG), or tert-butyl hydroquinone (TBHQ). In some aspects, the additive is an antiwear additive such as zinc dithiophosphate (ZDP), zinc dialkyl dithio phosphate (ZDDP), tricresyl phosphate (TCP), dioleoyl phosphite, bis(2-ethylhexyl) phosphate, diphenyl cresyl phosphate, triphenyl phosphorothionate, chlorinated paraffins, glycerol monooleate, or a combination thereof. The additives can include a corrosion inhibitor such as a thiadiazole, a benzotriazole, a tolutriazole, a zinc dithiophosphate, a metal phenolate, a metal sulfonate, a fatty acid, a carboxylic acid, an amine, and a combination thereof. The additive can include a detergent such as a polyisobutylene succinimide, a polyisobutylene amine succinamide, an aliphatic amine, a polyolefin maleic anhydride, or a combination thereof. Metal deactivators such as a triazole, a tolyltriazole, a thiadiazole, or a combination thereof can also be included as additives in some aspects. In some aspects, the additives include viscosity modifiers such as an ethylene-olefin co-polymer, a maleic anhydride-styrene alternating copolymer, a polymethacrylate, a hydrogenated styrene-butadiene copolymer, a hydrogenated styrene-isoprene copolymer, an ester thereof, or a combination thereof. The additives can also include dispersants such as succinimide, benzylamine, or a combination thereof.

In some aspects, this disclosure provides additive compositions for lubricating oils including a liquid lubricant composition described herein. In some aspects, a lubricant composition is provided having a petroleum or a synthetic base oil and about 40% or less by weight of a liquid lubricant composition descried herein. In some aspects, a lubricant composition is provided having a petroleum or a synthetic base oil and about 40% or less by weight of an oil from the seeds of the Brassicaceae *Orychophragmus violaceus*.

In some aspects, semisolid lubricants are provided wherein the oil is emulsified with a thickener. For example, an oil from the seeds of the Brassicaceae *Orychophragmus violaceus* can be emulsified with a thickener to form a semisolid lubricant. In some aspects, a mixture of triacylglycerols of 7,18-diOH $C_{24}$ fatty acids and estolides thereof are emulsified with a thickener to form a semisolid lubricant. Suitable thickeners can include a soap such as calcium stearate, sodium stearate, lithium stearate, lithium 12-hydroxystearate, and a combination thereof Methods of making lubricant compositions are also provided. The methods can include extracting oil from the seeds of the Brassicaceae *Orychophragmus violaceus*. The extractions can include grinding, heat, and/or solvent extractions. The methods can further include esterification of the oil with one or more fatty acids. The methods can also include mixing with one or more additives. If forming a semisolid lubricant, the methods can include forming an emulsion of the oil with a suitable thickener.

Other systems, methods, features, and advantages of lubricant compositions will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Further aspects of the present disclosure will be readily appreciated upon review of the detailed description of its various embodiments, described below, when taken in conjunction with the accompanying drawings.

DETAILED DESCRIPTION

Figure 1:
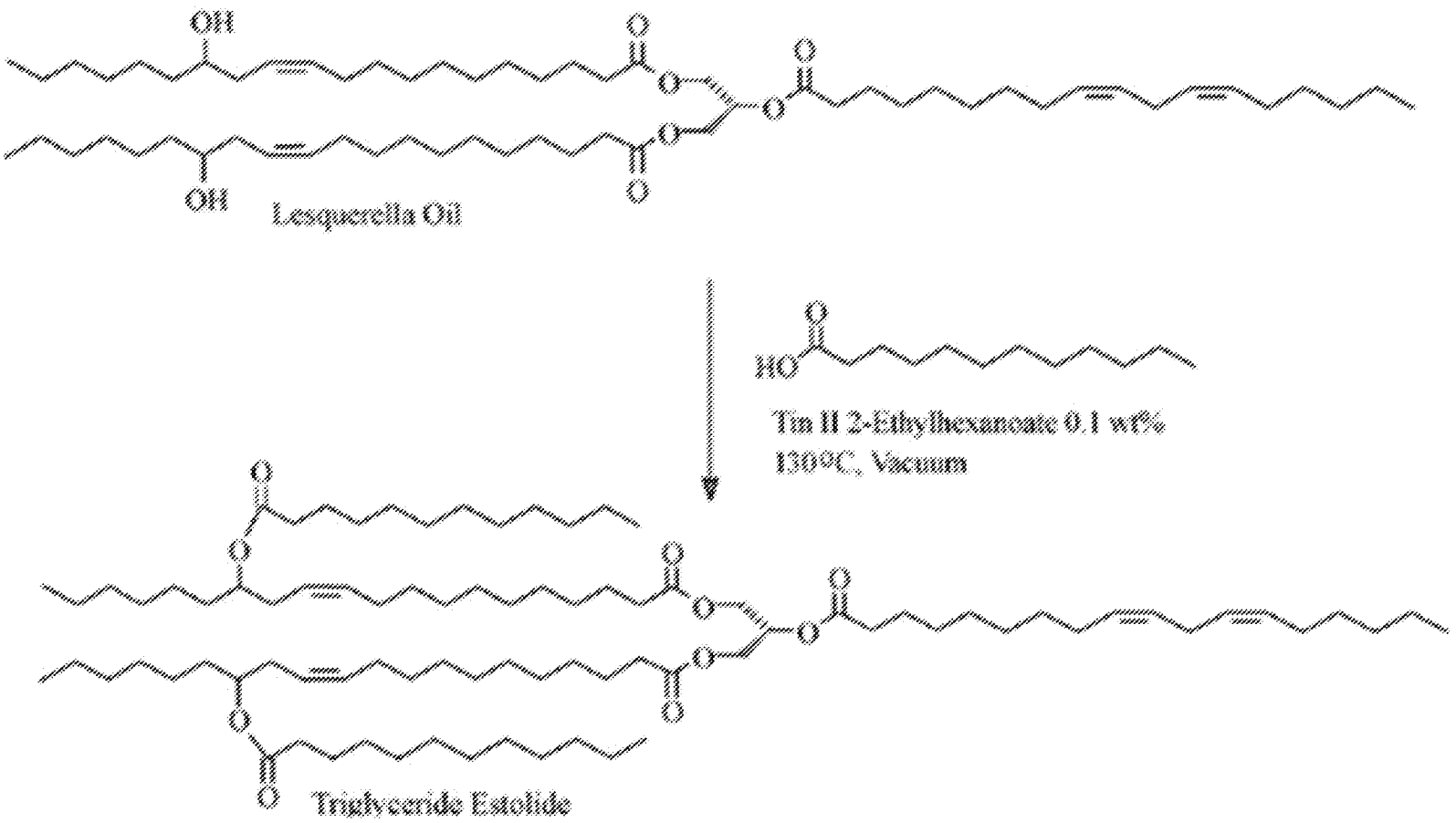
FIG. 1 is a structure of estolide molecules derived from *Lesquerella* seed oil by chemical catalysis.
Figure 2:
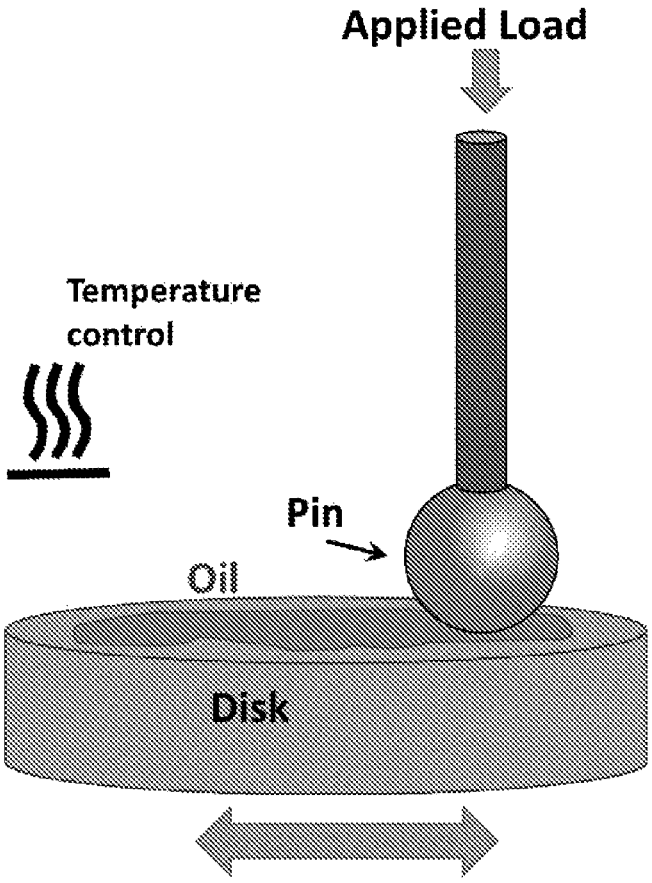
FIG. 2 shows schematic of the experimental setup employed for measuring lubrication characteristics of the oil using pin-on-disk macroscale tribometer at the reciprocating mode with precise temperature control up to 450° C. During the experiments the applied load changed from 5 N to 20N, reciprocating speed varied from 1 Hz to 10 Hz with 10 mm wear track length
Figure 3A:
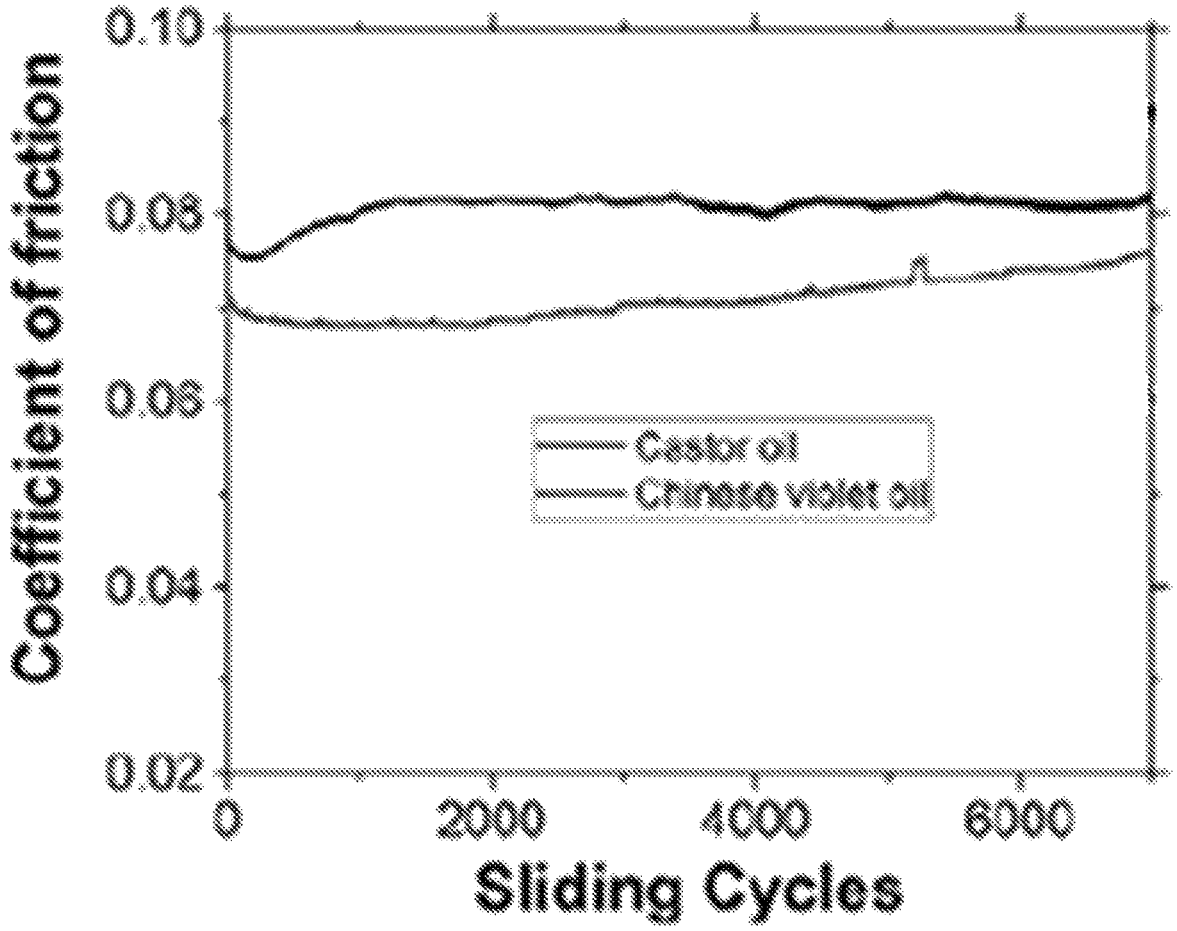
FIGS. 3A-3C show a comparison of lubricative properties of castor oil and Chinese violet seed oil (Ov oil) during sliding at room temperature. Reduction both in COF (FIG. 3A) and wear (FIG. 3C) in case of the Ov oil is demonstrated.
Figure 3B:
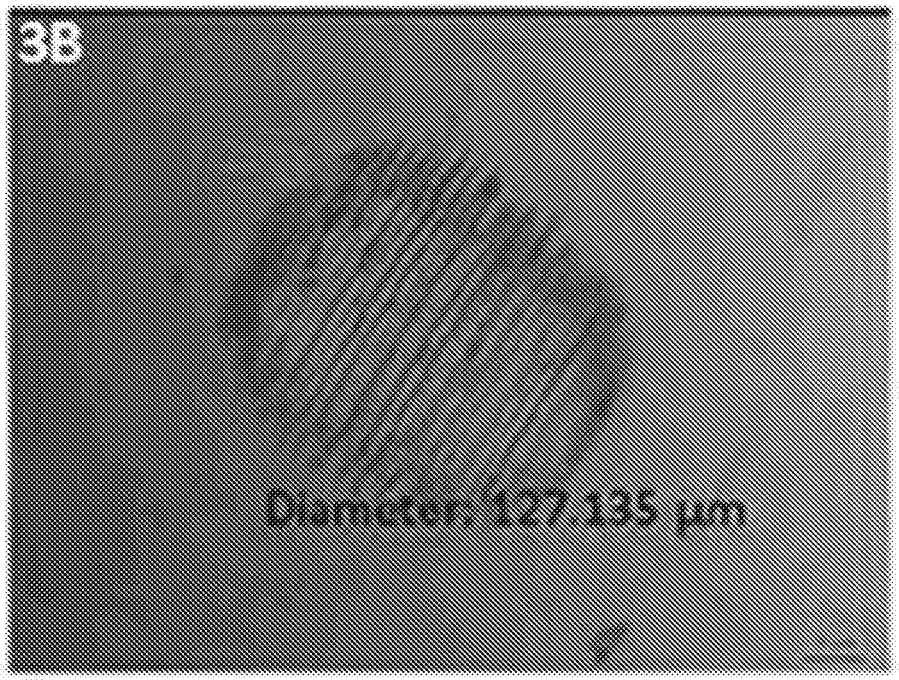
Figure 3C:
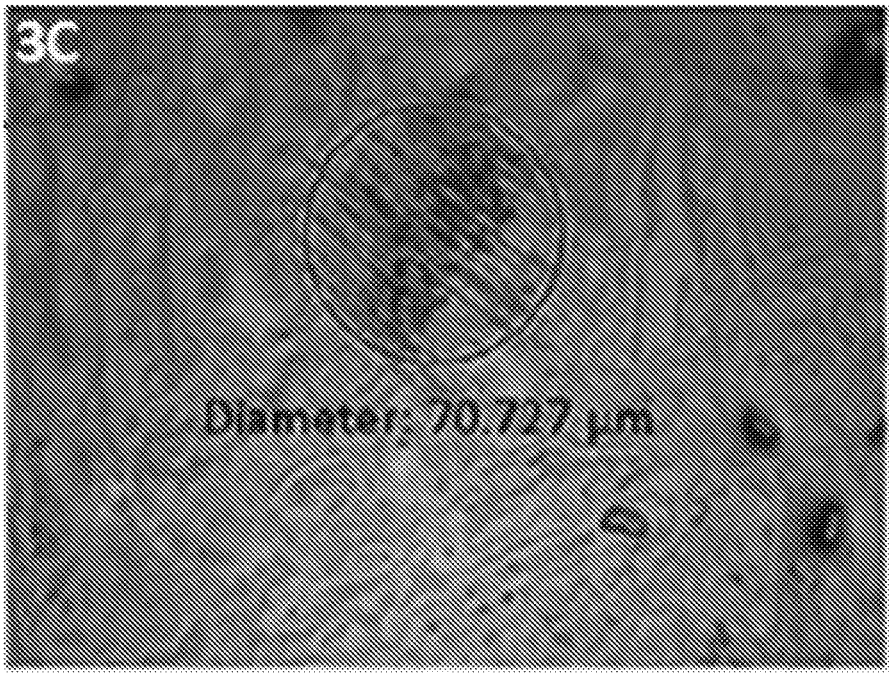
Figure 4A:
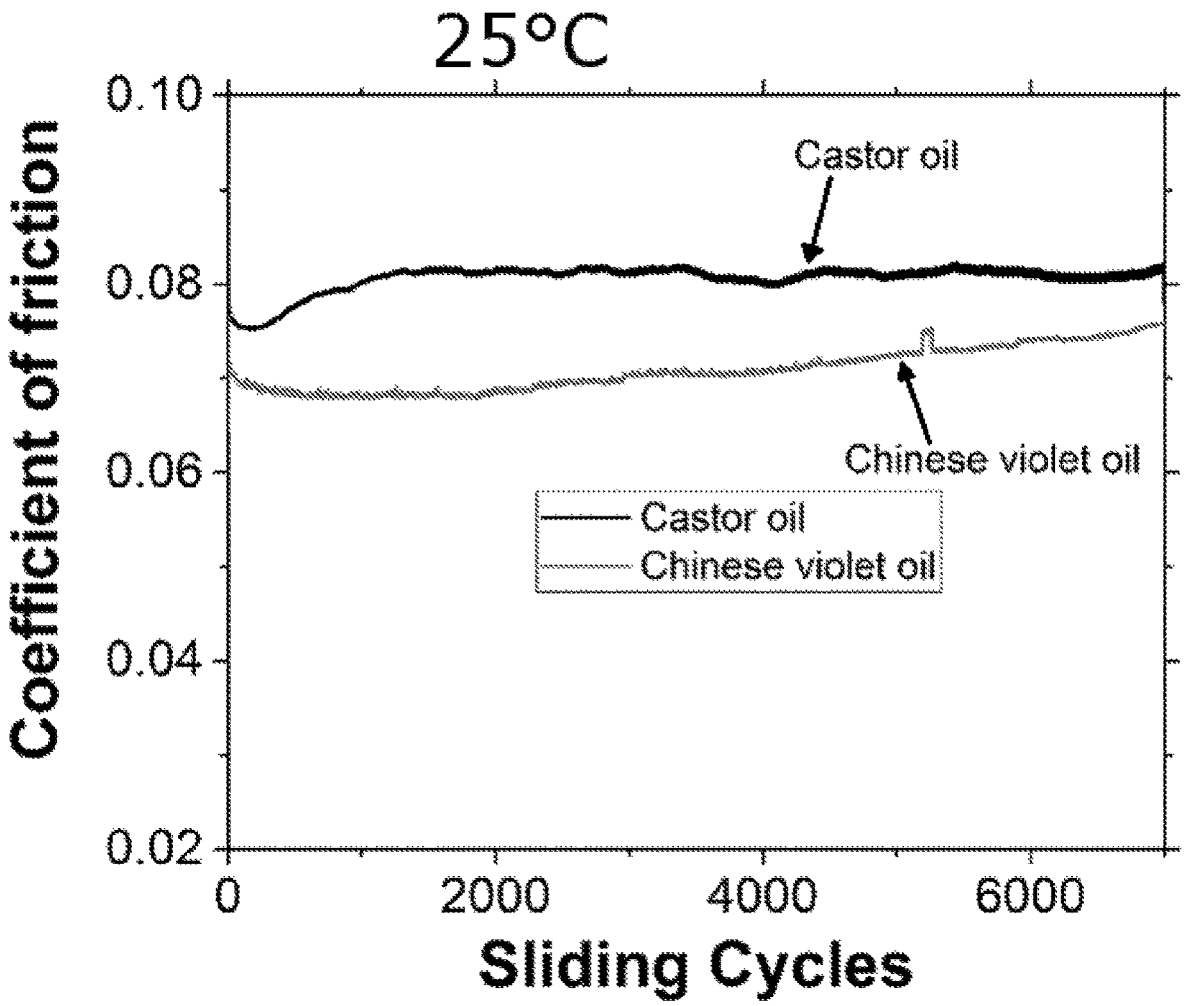
FIGS. 4A-4D shows comparison of lubricative properties of castor oil and Ov oil during sliding (FIG. 4A) at room temperature, (FIG. 4B) at 100° C., (FIG. 4C) at 150° C., and (FIG. 4D) at 200° C. In all the tested regimes Ov oil demonstrates smaller friction and better stability.
Figure 4B:
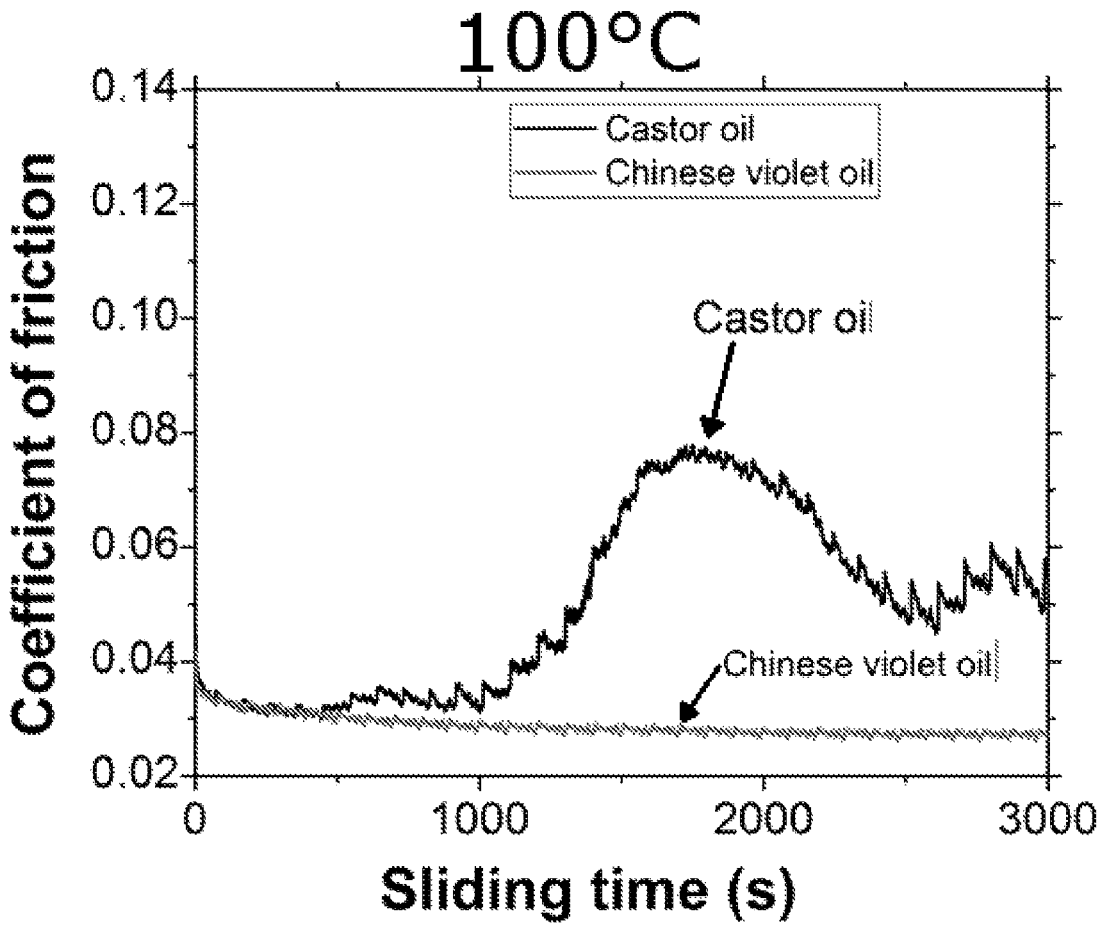
Figure 4C:
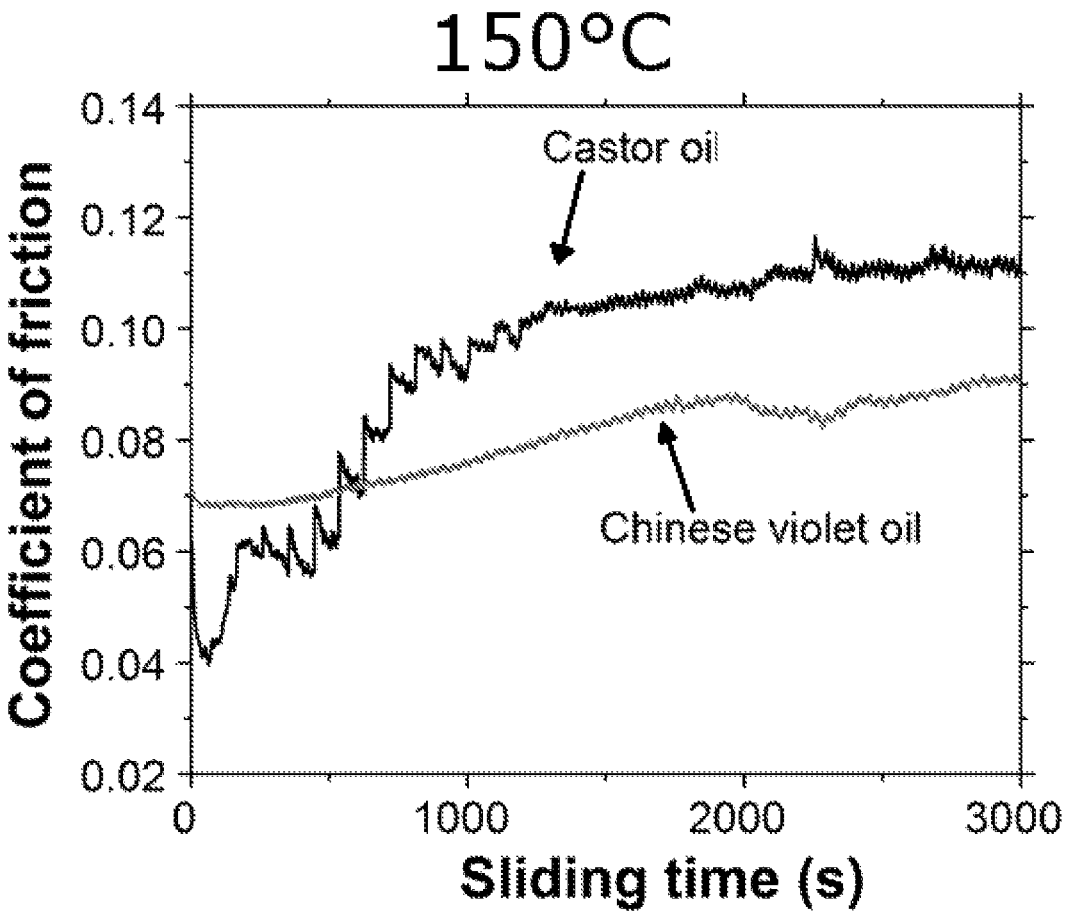
Figure 4D:
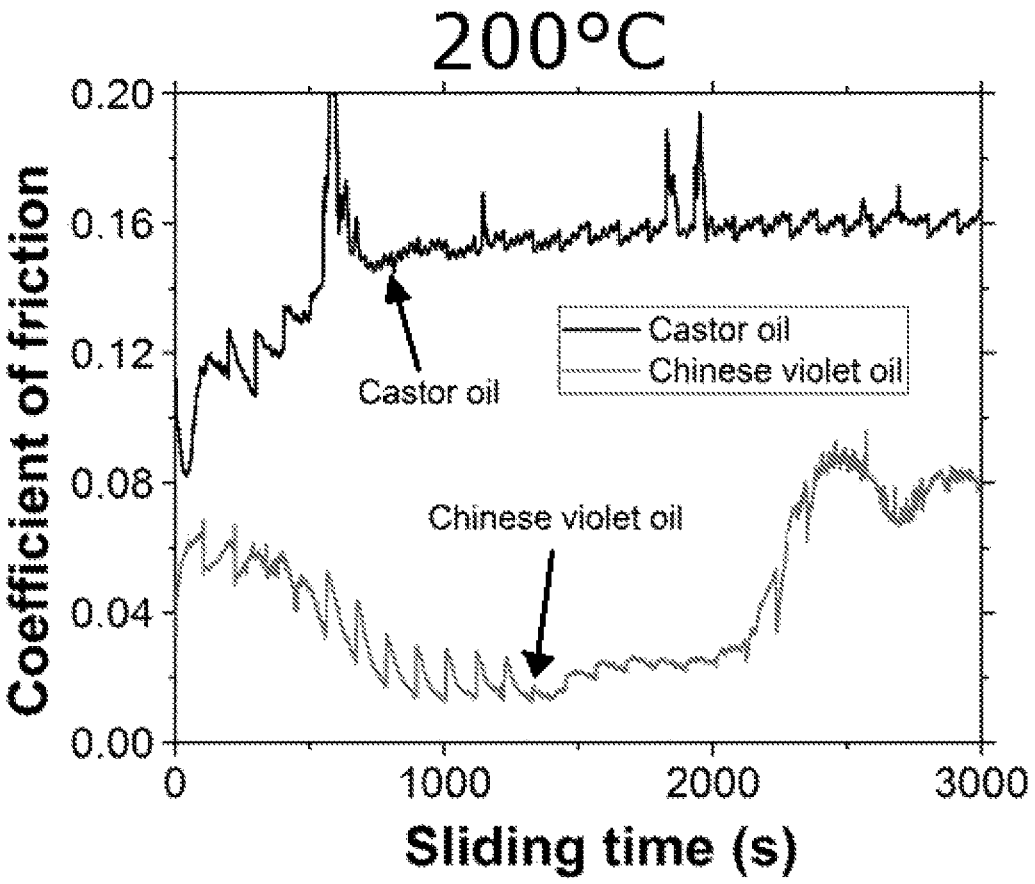

In various aspects, the disclosure is directed to lubricant compositions and methods of making lubricant compositions. Lubricant compositions made with oils derived or extracted, extruded, or pressed from Brassicaceae *Orychophragmus violaceus* have been determined to have a variety of beneficial properties. The lubricants can include liquid and semisolid lubricants.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting. The skilled artisan will recognize many variants and adaptations of the embodiments described herein. These variants and adaptations are intended to be included in the teachings of this disclosure and to be encompassed by the claims herein.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant specification should not be treated as such and should not be read as defining any terms appearing in the accompanying claims. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

Although any methods and materials similar or equivalent to those described herein can also be used in the practice or testing of the present disclosure, the preferred methods and materials are now described. Functions or constructions well-known in the art may not be described in detail for brevity and/or clarity. Embodiments of the present disclosure will employ, unless otherwise indicated, techniques of nanotechnology, organic chemistry, material science and engineering and the like, which are within the skill of the art. Such techniques are explained fully in the literature.

It should be noted that ratios, concentrations, amounts, and other numerical data can be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to about 5%" should be interpreted to include not only the explicitly recited values of about 0.1% to about 5%, but also include individual values (e.g., 1%, 2%, 3%, and 4%) and the sub-ranges (e.g., 0.5%, 1.1%, 2.2%, 3.3%, and 4.4%) within the indicated range. Where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In some embodiments, the term "about" can include traditional rounding according to significant figures of the numerical value. In addition, the phrase "about 'x' to 'y'", where 'x' and 'y' are numerical values, includes "about 'x' to about 'y'".

DEFINITIONS

Unless defined otherwise, all technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

The articles "a" and "an," as used herein, mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

The term "fatty acid," as used herein, refers to a saturated or unsaturated monocarboxylic acid having an aliphatic tail, which may include from about 4 to about 32 carbon atoms. The fatty acid may be a saturated monocarboxylic acid having the general formula $C_nH_{2n+1}COOH$, wherein n is a positive integer. In one example, n may be from about 4 to about 28. The aliphatic tail of the fatty acid may have on or more hydroxyl functional groups, or the tail of the fatty acid may be free of hydroxyl functional groups. The fatty acid may occur naturally in the form of esters in fats, waxes, and essential oils or in the form of glycerides in fats and fatty oils. Examples of fatty acids can include, but are not limited to, oleic acid, myristic acid, palmitic acid, rumenic acid, vaccenic acid, myrisoleic acid, palmitoleic acid, stearic acid, and alpha-linoleic acid. It may also include any other conventional fatty acids, derivatives thereof, and combinations thereof. For ease of description, fatty acids will in some aspects be described using the nomenclature "X:Y—$(OH)_z$" where X is the number of carbon atoms in the chain, Y is the number of double bonds in the chain, and Z is the number of hydroxyl groups. If there are no hydroxyl groups, the nomenclature is simply "X:Y". For example, a fatty acid having 24 carbon atoms, 1 double bond, and 2 hydroxyl groups can be denoted by "24:1-$(OH)_2$".

The terms "triacylglycerol" and "triacylglyceride", as interchangeably used herein, refer to tri esters of three fatty acids (or estolides thereof) and glycerol. For ease of description, triacylglycerols will in some aspects be described by the structure of each of the fatty acids from which it is derived using the nomenclature [X:Y—$(OH)_z$]—[X:Y—$(OH)_z$]—[X:Y—$(OH)_z$] where each occurrence "X:Y—$(OH)_z$" describes the structure of one of the three fatty acids in the triacylglyceride and can be the same or different. For example, [18:2]-[18:2]-[24:1-$(OH)_2$] describes the tri ester of glycerol with three fatty acids with (i) two of them having 18 carbon atoms and 2 double bonds and (ii) the third having 24 carbon atoms, 1 double bond, and 2 hydroxyl groups.

The term "estolide," as used herein, refers to a fatty acid or an ester thereof having a secondary ester linkage of one or more additional fatty acids to an alkyl backbone. The nomenclature of estolides will be, in some aspects, by identifying the two or more fatty acids using the nomenclature for fatty acids described above. For example, 18:2-$(OH)_1$-18:1$(OH)_2$ describes an estolide of the fatty acid 18:2-$(OH)_1$ having a secondary ester linkage of 18:1$(OH)_2$ attached thereto. The estolide nomenclature can also be combined with the nomenclature for triacylglycerols described above.

The term "petroleum oil," as used herein, refers to oils produced entirely or primarily from fossil material, such as petroleum, natural gas, coal, etc.

The term "synthetic oil," as used herein, refers to products produced by reacting carboxylic acids with glycerol, e.g., glycerol triacetate, and the like. It will be understood that such synthetic oils can contain between about 0.1 wt % to about 20 wt. % mono- and di-glycerides, and mixtures thereof.

The term "semisolid," as used herein, refers to compositions that at or around room temperature, e.g. at a temperature of about 15° C. to 25° C., are not free flowing in the same way as a liquid and may have a consistency of a paste, cream, or a grease.

Lubricant Compositions

In various aspects of this disclosure, lubricant compositions are provided containing oil from the seeds of the Brassicaceae *Orychophragmus violaceus* (Chinese violet cress, February orchid) plant. Previous results indicated that this seed oil appears to make unusual long chain di-hydroxy fatty acids for its seed oil. The fatty acids incorporated into triacylglycerols are 7,18-diOH $C_{24}$ with one or two double bonds. This is different from the hydroxy fatty acids in castor oil, which are shorter chain and contain only one hydroxyl moiety. Ov oil acids are believed to form estolides, a feature that has been reported to demonstrate excellent lubricant properties.[17,18]

In some aspects, this disclosure describes lubricant compositions including an oil high in oleic acid, linoleic acid, palitmic acid, triacylglycerols thereof, estolides thereof, and mixtures thereof. In some aspects, the disclosure describes lubricant compositions including an oil that is low in linoleic acid, erucic acid, triacylglycerols thereof, estolides thereof, and mixtures thereof. As used herein, a lubricant composition is said to be "high in" a particular component when that component is present in an amount of about 40%, 50%, 60%, 70% or more by weight based up a total weight of the composition. As used herein, a lubricant composition is said to be "low in" a particular component when that component is present in an amount of about 15%, 10%, 5% or less by weight based up a total weight of the composition. In some aspects, the disclosure describes lubricant compositions including a mixture of the triacylglycerol [18:2]-[18:2]-[24:1-$(OH)_2$] and estolides thereof. In some aspects, the disclosure describes lubricant compositions that include a mixture of estolides of the triacylglycerol [18:2]-[18:2]-[24:1-$(OH)_2$]. The estolides can include [18:2]-[18:2]-[24:1-$(OH)_2$-24:2-$(OH)_2$], [18:2]-[18:2]-[24:1-$(OH)_2$-24:2-$(OH)_2$-24:1-$(OH)_2$], [18:2]-[18:2]-[24:1-$(OH)_2$-24:2-$(OH)_2$-24:1-$(OH)_2$-24:1-$(OH)_2$], and combinations thereof. In some aspects, 24:1-$(OH)_2$ has a structure according to the following formula

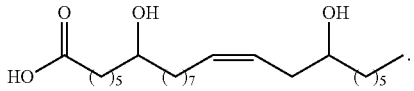

In some aspects, 24:2-$(OH)_2$ has a structure according to the following formula

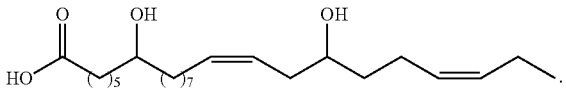

In some aspects, the ratio of 24:1-$(OH)_2$ to 24:2-$(OH)_2$ (wt/wt) is about 1:3. In some aspects, the total amount of 24:1-$(OH)_2$ to 24:2-$(OH)_2$ is about 50% (wt/wt) of the total fatty acid content in the composition.

In some aspects, the Ov oil has been processed to increase the estolide content. For example, the estolide content can be increased via esterification of a triacylglycerol. Suitable esterification reactions are described, for instance, in U.S. Pat. No. 5,427,704 to Lawate, the contents of which are incorporated by reference. In some aspects, the oil is esterified with one or more C 24:2 (OH)2 and C24:1 (OH2) fatty acids. In some aspects, the estolides are capped, i.e. containing a non-hydroxlated fatty acid. In some aspects, the estolides are uncapped, i.e. containing a di-dhydroxy fatty acid.

The lubricant compositions can be liquid or semi-solid lubricant compositions. The lubricant compositions can include oil from the seeds of the Brassicaceae *Orychophragmus violaceus*. The lubricant compositions can include an oil having a mixture of triacylglycerols of 7,18-diOH $C_{24}$ fatty acids and estolides thereof. In some aspects, the oil is esterified with one or more fatty acids, e.g. of palmitoleic acid, oleic acid, linoleic acid, lauric acid, palmitic acid, stearic acid, or a combination thereof.

In various aspects, the lubricant compositions include one or more additives. Additives can be oil additives and/or grease additives. In various aspects, the additives are antioxidant such as (+)-α-tocopherol (TCP), propyl gallate (PG), l-ascorbic acid 6-palmitate (AP), 4,4'-methylenebis(2,6-di-tert-butylphenol) (MBP), butylated hydroxyl anisole (BHA), butylated hydroxyl toluene (BHT), propyl gallate (PG), or tert-butyl hydroquinone (TBHQ). In some aspects, the additive is an antiwear additive such as zinc dithiophosphate (ZDP), zinc dialkyl dithiophosphate (ZDDP), tricresyl phosphate (TCP), dioleoyl phosphite, bis(2-ethylhexyl) phosphate, diphenyl cresyl phosphate, triphenyl phosphorothionate, chlorinated paraffins, glycerol monooleate, or a combination thereof. The additives can include a corrosion inhibitor such as a thiadiazole, a benzotriazole, a tolutriazole, a zinc dithiophosphate, a metal phenolate, a metal sulfonate, a fatty acid, a carboxylic acid, an amine, and a combination thereof. The additive can include a detergent such as a polyisobutylene succinimide, a polyisobutylene amine succinamide, an aliphatic amine, a polyolefin maleic anhydride, or a combination thereof. Metal deactivators such as a triazole, a tolyltriazole, a thiadiazole, or a combination thereof can also be included as additives in some aspects. In some aspects, the additives include viscosity modifiers such as an ethylene-olefin co-polymer, a maleic anhydride-styrene alternating copolymer, a polymethacrylate, a hydrogenated styrene-butadiene copolymer, a hydrogenated styrene-isoprene copolymer, an ester thereof, or a combination thereof. The additives can also include dispersants such as succinimide, benzylamine, or a combination thereof.

In some aspects, this disclosure provides additive compositions for lubricating oils including a liquid lubricant composition described herein. In some aspects, a lubricant composition is provided having a petroleum or a synthetic base oil and about 40%, about 30%, about 20%, about 10%, or less by weight of a liquid lubricant composition descried herein. In some aspects, a lubricant composition is provided having a petroleum or a synthetic base oil and about 40%, about 30%, about 20%, about 10%, or less by weight of an oil from the seeds of the Brassicaceae *Orychophragmus violaceus.*

In some aspects, semisolid lubricants are provided wherein the oil is emulsified with a thickener. For example, an oil from the seeds of the Brassicaceae *Orychophragmus violaceus* can be emulsified with a thickener to form a semisolid lubricant. In some aspects, a mixture of triacylglycerols of 7,18-diOH $C_{24}$ fatty acids and estolides thereof are emulsified with a thickener to form a semisolid lubricant. Suitable thickeners can include a soap such as calcium stearate, sodium stearate, lithium stearate, lithium 12-hydroxystearate, and a combination thereof.

Methods of Making Lubricant Compositions

Methods of making lubricant compositions are also provided. The methods can include extracting oil from the seeds of the Brassicaceae *Orychophragmus violaceus*. The extractions can include grinding, heat, and/or solvent extractions. The methods can further include esterification of the oil with one or more fatty acids. The methods can also include mixing with one or more additives. If forming a semisolid lubricant, the methods can include forming an emulsion of the oil with a suitable thickener.

The seed can be cleaned and dried and foreign material can be removed. Crushing can be done using mill, steel rollers, or other suitable means. The seeds can be mechanically pressed in expellers after a preheating step in indirectly heated conditioners. The oil bearing material can be fed into one end of a cylinder where a power-driven worm conveyor forces the material to the other end of the cylinder and out against resistance. The pressure exerted in the process can extract out the oil.

Solvent extraction can be used to separate oil from the seeds. The pre-processed seeds can be treated in a multistage counter current process with solvent until the remaining oil content is reduced. The mixture of oil and solvent can be separated by distillation and the solvent can be recycled into the extraction process.

Uses of Lubricant Compositions

The lubricant compositions can be used in a variety of applications, for example in engines or in other industrial applications. The lubricant compositions can replace many uses of petroleum-based lubricants and/or many uses of castor oil based lubricants. Any number of applications will be readily ascertained upon reading the present disclosure when accompanied with the below examples.

EXAMPLES

Now having described the embodiments of the present disclosure, in general, the following Examples describe some additional embodiments of the present disclosure. While embodiments of the present disclosure are described in connection with the following examples and the corresponding text and figures, there is no intent to limit embodiments of the present disclosure to this description. On the contrary, the intent is to cover all alternatives, modifications, and equivalents included within the spirit and scope of embodiments of the present disclosure.

To seed this project on exploring lubrication performance of the newly discovered Chinese Violet (*Orychophragmus violaceus*) seed oil (Ov oil) and understanding the origin of its lubricative properties preliminary tests were performed outlining the physical properties and stability of new Chinese Violet seed oil and demonstrating its improved tribological performance in comparison to castor oil. These results demonstrate feasibility of the hypotheses and highlight needs for further careful study.

FIG. 1 presents predicted structure of the estolides in Ov oil. FIG. 1 is a structure of estolide molecules derived from *Lesquerella* seed oil by chemical catalysis.[23] Structures like these (except with esters on dihydroxy long chain acyl groups) occur naturally in Chinese Violet Seed Oil (Ov oil), thus providing a source of estolides for high performance lubrication applications. Table 1 summarizes comparative analysis of the measured properties for castor oil and Ov oil. Initial viscosity measurements were performed on the first batch of oil samples extruded from the seeds. Results indicate high viscosity of Ov oil, which is thought to originate from the presence of estolides. High thickness and viscosity of the new oil are important parameters for grease creation as they demonstrate reduced needs for thickening agents and thus easier process of synthesis.

TABLE 1

Comparative analysis of the measured properties for castor oil and Ov oil

| | Castor oil | Ov oil |
|---|---|---|
| Density (g/mL) | 0.959 | 0.905 |
| Room Temperature Viscosity (mPa · s) | 630 | 1220 |

In order to explore potential for the Ov oil to be used in practical applications its lubricative properties were tested for reducing friction and wear of sliding steel surfaces.

The friction and wear experiments were carried out using a macroscale ball-on-disk tribometer (Anton Paar) connected to the heating stage. A stationary 6 mm-in-diameter steel ball was pressed against a sliding steel disk (440C steel grade). The tests were performed in a linear reciprocating mode (6 mm sliding distance, 1 Hz period of sliding). Applied contact load was 5N (maximum Hertzian contact pressure is 1.1 GPa). The tests were performed in ambient air with 30% relative humidity at room temperature and at 100° C. temperature. Prior to the tests the samples were cleaned with acetone and isopropanol and dried in a dry nitrogen flow. The root mean square roughness of the steel surfaces was 20 nm. During the tests, lubricative properties of the freshly-press-extruded Ov oil were compared to the ones of a store-bought castor oil (kinematic viscosity of castor oil is ~630 mPa·s). The oils were applied with a syringe in the amounts of 0.05 ml, sufficient to fully cover the sliding steel surfaces. The wear marks on the ball and disk samples were further characterized with a Nikon Eclipse optical microscope.

FIGS. 3A-3C and FIGS. 4A-4D summarize the coefficient of friction and wear results for a freshly extruded Ov oil in comparison to a commonly used biolubricant, castor oil [8, 11]. For the tests performed at room temperature, use of the Ov oil results in 20% reduction in friction (FIG. 3*a*) and lower wear (FIG. 3*b*) in comparison to the castor oil (3*c*), which demonstrates excellent promises for Ov oil as a biolubricant. However, once the temperature for the tests increased up to 100° C. (FIG. 4*b*), the coefficient of friction for the Ov oil sliding decreased dramatically to 0.03 value, which is 3 times lower than the coefficient of friction for the castor oil. Notably, in case of castor oil at the elevated temperature, the friction is high and sporadic, indicating eventual degradation of the oil during the test. In contrast, coefficient of friction for the Ov oil is low and stable. Demonstrated excellent lubricative properties of the Ov oil are important for the applications requiring higher-than-room-temperature operating conditions, when traditional biolubricants are not efficient.

Figure 5A:
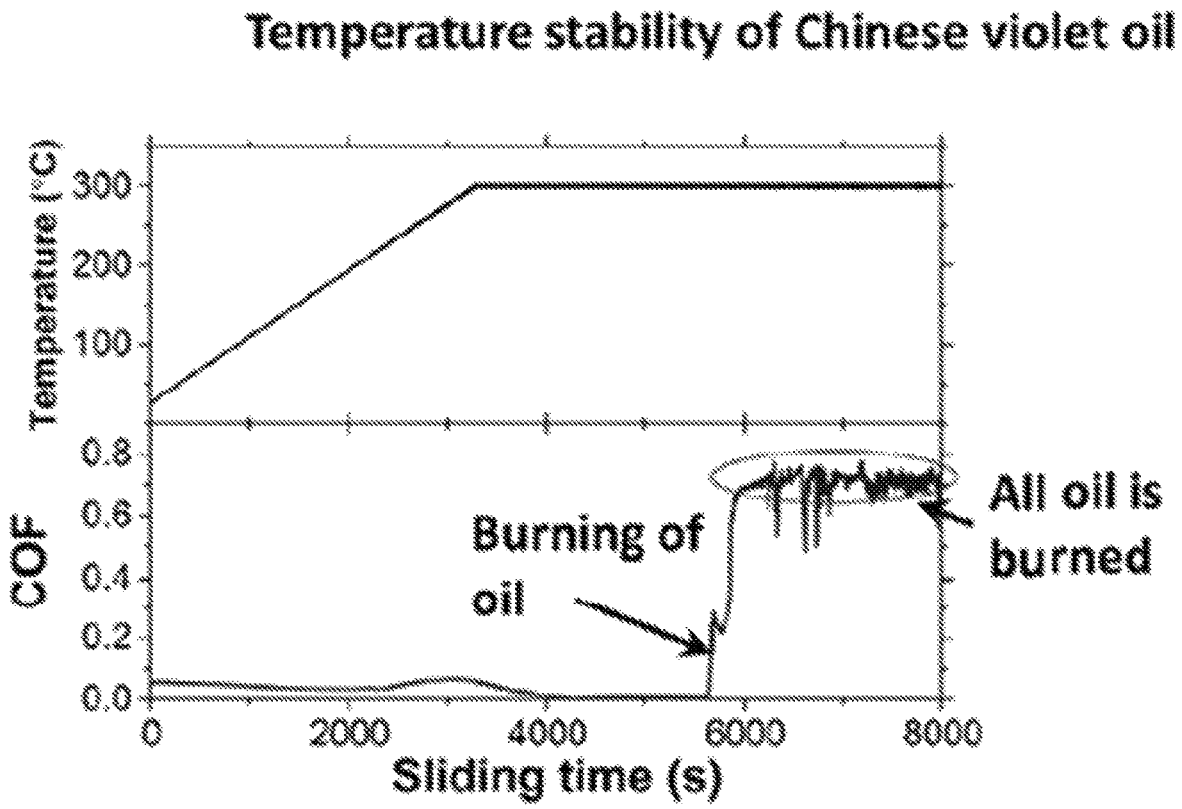
FIGS. 5A-5B shows stability of the (FIG. 5A) Ov oil in comparison to (FIG. 5B) the castor oil during prolonged test at 300° C.
Figure 5B:
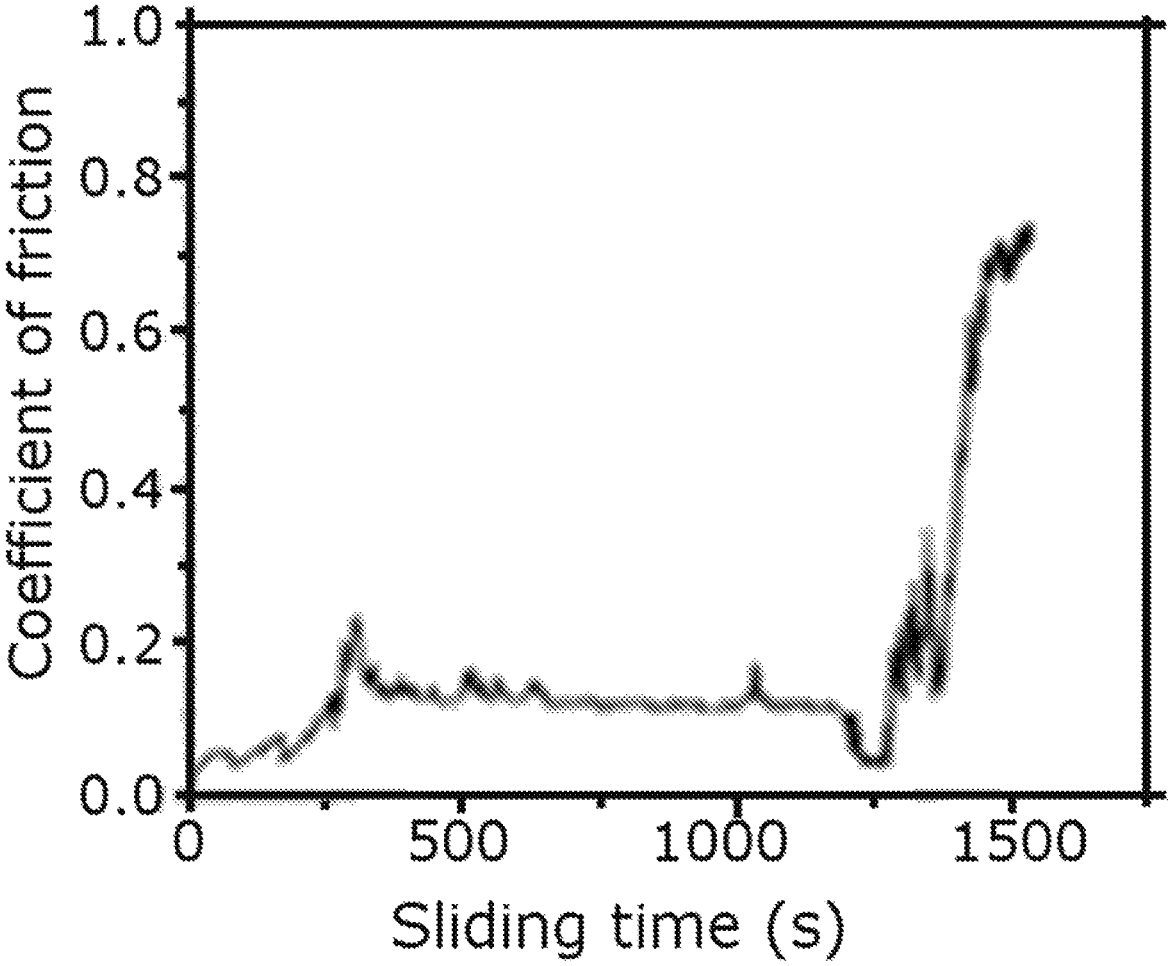
Figure 6A:
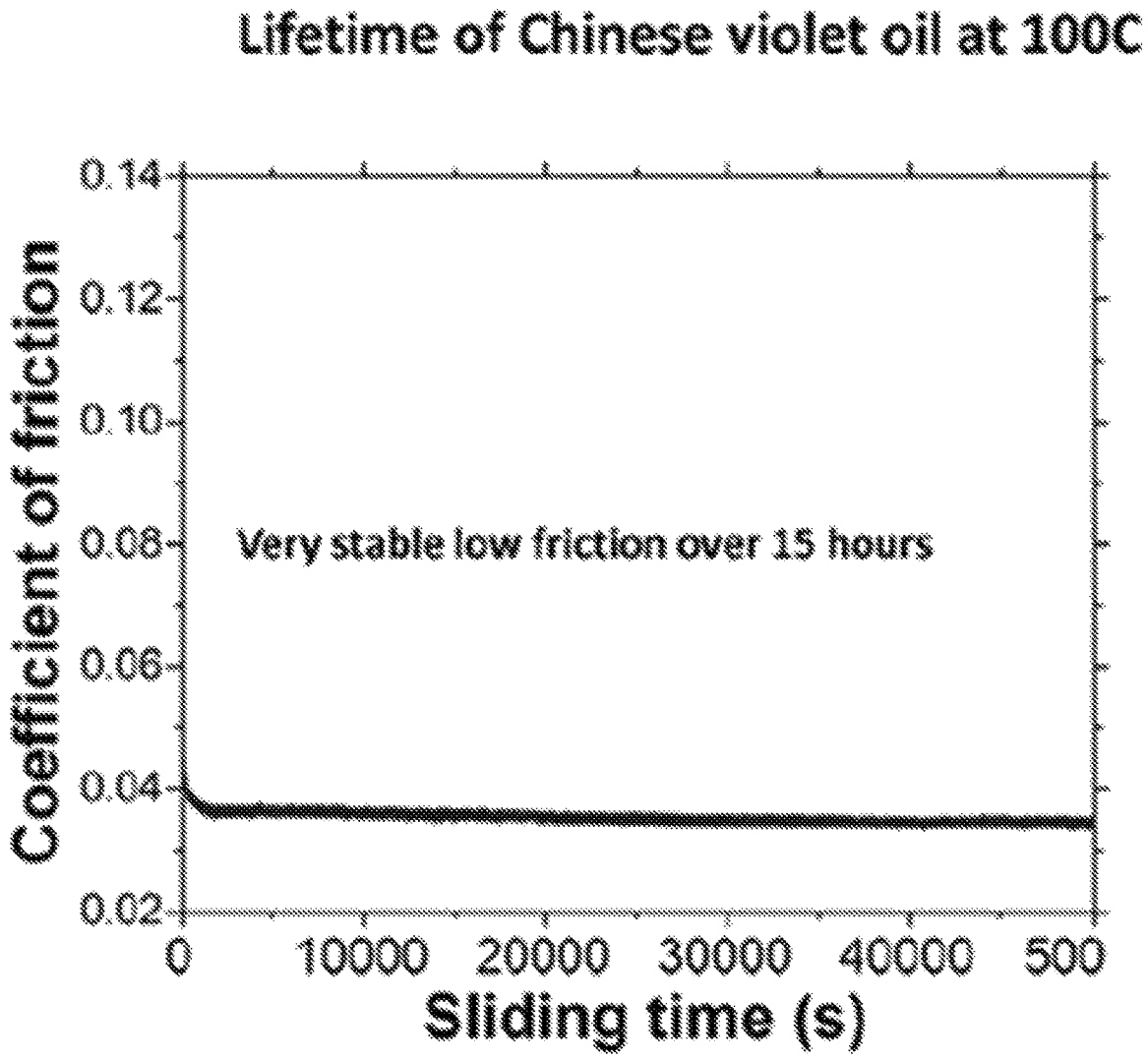
FIGS. 6A-6B shows stability of the (FIG. 6A) Ov oil in comparison to (FIG. 6B) the castor oil during prolonged test (50,000 cycles or 1 km) at 100° C.
Figure 6B:
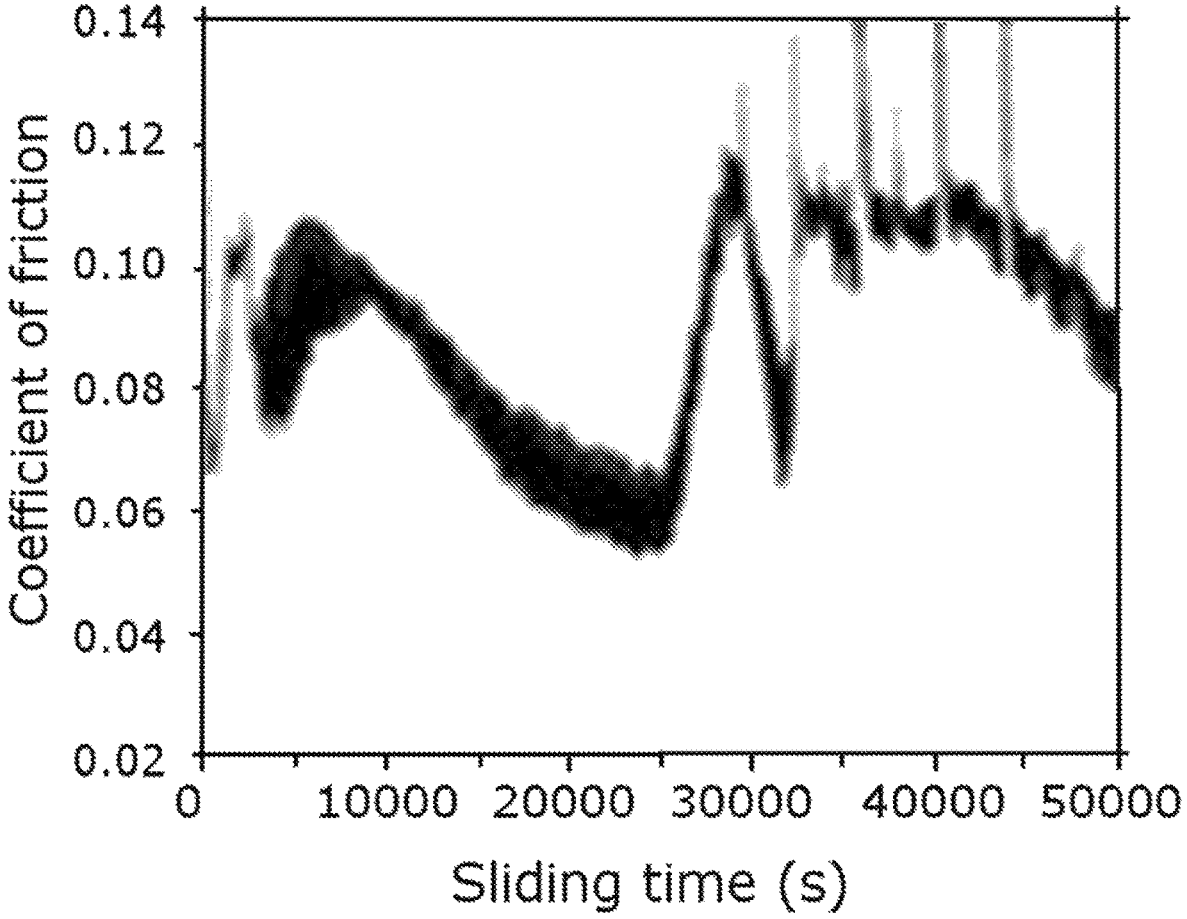

To analyze lubricative potential of Ov as compared with castor oil, a number of initial tribological tests were performed. Stainless steel samples were immersed in an oil bath installed in a macroscale pin-on-disk tribometer. A stainless steel ball of 6 mm in diameter was used as a counterpart during sliding tests performed under 10N applied load and at 60 rpm rotational speed. Our results indicate improved lubricative properties of the Ov oil compared to castor oil (FIGS. 5A-5C). Both friction and wear of the steel samples tested in the Ov oil are lower than for castor oil. These results show great potential for the Ov oil as a new class of biolubricants and in combination with physical properties suggest its application in biodegradable greases.

It should be emphasized that the above-described embodiments of the present disclosure are merely possible examples of implementations, and are set forth only for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

REFERENCES

[1] A. Cameron, The Principles of Lubrication, Wiley, 1966.

[2] M. M. Khonsari, E. R. Booser, Applied Tribology: Bearing Design and Lubrication, John Wiley & Sons, New York, N.Y., 2001.

[3] J. Salimon, N. Salih, E. Yousif, Biolubricants: Raw materials, chemical modifications and environmental benefits, European Journal of Lipid Science and Technology 112 (2010) 519-530.

[4] D. H. Meadows, D. L. Meadows, J. Randers, W. W. Behrens III, The limits to growth: A report for the club of Rome's project on the predicament of mankind, Nova York, New American Library (1972).

[5] J. Y. Park, M. Salmeron, Fundamental aspects of energy dissipation in friction, Chem Rev 114 (2013) 677-711.

[6] A. Z. Szeri, Tribology: Friction, Lubrication, and Wear Hemisphere, 1980.

[7] H. Olsson, K. J. Åström, C. C. De Wit, M. Gäfvert, P. Lischinsky, Friction models and friction compensation, European Journal of Control 4 (1998) 176-195.

[8] B. J. Hamrock, S. R. Schmid, B. O. Jacobson, Fundamentals of fluid film lubrication, CRC Press, 2004.

[9] A. Erdemir, G. Ramirez, O. L. Eryilmaz, B. Narayanan, Y. Liao, G. Kamath, S. K. R. S. Sankaranarayanan, Carbon-based tribofilms from lubricating oils, Nature 536 (2016) 67-71.

[10] B. R. Keeble, The Brundtland report: 'Our common future', Medicine and War 4 (1988) 17-25.

[11] S. Asadauskas, J. H. Perez, J. L. Duda, Lubrication properties of castor oil—potential basestock for biodegradable lubricants, Tribology & Lubrication Technology 53 (1997) 35.

[12] R. Sánchez, J. Franco, M. Delgado, C. Valencia, C. Gallegos, Development of new green lubricating grease formulations based on cellulosic derivatives and castor oil, Green chemistry 11 (2009) 686-693.

[13] R. Sánchez, J. Franco, M. Delgado, C. Valencia, C. Gallegos, Rheological and mechanical properties of oleogels based on castor oil and cellulosic derivatives potentially applicable as bio-lubricating greases: Influence of cellulosic derivatives concentration ratio, Journal of Industrial and Engineering Chemistry 17 (2011) 705-711.

[14] G. Balint, Ricin: the toxic protein of castor oil seeds, Toxicology 2 (1974) 77-102.

[15] V. Scholz, J. N. da Silva, Prospects and risks of the use of castor oil as a fuel, Biomass and Bioenergy 32 (2008) 95-100.

[16] D. M. Schieltz, S. C. McGrath, L. G. McWilliams, J. Rees, M. D. Bowen, J. J. Kools, L. A. Dauphin, E. Gomez-Saladin, B. N. Newton, H. L. Stang, Analysis of active ricin and castor bean proteins in a ricin preparation, castor bean extract, and surface swabs from a public health investigation, Forensic science international 209 (2011) 70-79.

[17] J. Hermes, An Emerging New Class of Base Oils, Energy Manager Today, 2013.

[18] T. Isbell, S. Cermack, Estolides a Developing Versatile Lubricant Base-stock, Society of Tribologists and Lubrication Engineers Trade Journal, 2014.

[19] P. J. Horn, K. D. Chapman, Lipidomics in situ: Insights into plant lipid metabolism from high resolution spatial maps of metabolites, Progress in Lipid Research 54 (2014) 32-52.

[20] D. Sturtevant, Y.-J. Lee, K. D. Chapman, Matrix assisted laser desorption/ionization-mass spectrometry imaging (MALDI-MSI) for direct visualization of plant metabolites in situ, Current Opinion in Biotechnology 37 (2016) 53-60.

[21] Q. Chang, P. Rudenko, D. J. Miller, J. Wen, D. Berman, Y. Zhang, B. Arey, Z. Zhu, A. Erdemir, Operando formation of an ultra-low friction boundary film from synthetic magnesium silicon hydroxide additive, Tribology International 110 (2017) 35-40.

[22] K. D. Chapman, J. B. Ohlrogge, Compartmentation of Triacylglycerol Accumulation in Plants, The Journal of Biological Chemistry 287 (2012) 2288-2294.

[23] T. A. Isbell, B. A. Lowery, S. S. DeKeyser, M. L. Winchell, S. C. Cermak, Physical properties of triglyceride estolides from *lesquerella* and castor oils, Industrial crops and products 23 (2006) 256-263.

The various aspects of the above disclosure will be better understood upon viewing the following clauses, which should not be confused with the claims.

Clause 1. A liquid lubricant composition comprising oil from the seeds of the Brassicaceae *Orychophragmus violaceus.*

Clause 2. A liquid lubricant composition comprising a mixture of triacylglycerols of 7,18-OH C:24 fatty acids and estolides thereof.

Clause 3. A liquid lubricant composition comprising an oil from the seeds of the Brassicaceae *Orychophragmus violaceus* that has been esterified with one or more fatty acids.

Clause 4. The liquid lubricant composition according to Clause 3, wherein the one or more fatty acids are selected from the group consisting of palmitoleic acid, oleic acid, linoleic acid, lauric acid, palmitic acid, stearic acid, and a combination thereof.

Clause 5. A liquid lubricant composition comprising the triacylglycerol [18:2]-[18:2]-[24:1-$(OH)_2$] and estolides thereof.

Clause 6. The liquid lubricant composition according to Clause 5, wherein the estolides are selected from the group consisting of [18:2]-[18:2]-[24:1-$(OH)_2$-24:2-$(OH)_2$], [18:2]-[18:2]-[24:1-$(OH)_2$-24:2-$(OH)_2$-24:1-$(OH)_2$], [18:2]-[18:2]-[24:1-$(OH)_2$-24:2-$(OH)_2$-24:1-(OH)2-24:1-(OH)2], and a combination thereof.

Clause 7. The liquid lubricant composition according to Clause 5 or Clause 6, wherein 24:1-$(OH)_2$ has a structure according to the following formula

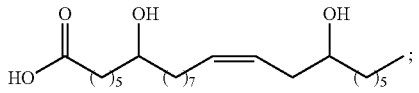

and wherein 24:2-$(OH)_2$ has a structure according to the following formula

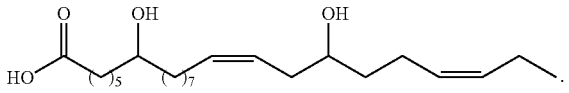

Clause 8. The liquid lubricant composition according to any one of Clauses 1-7, further comprising one or more oil additives.

Clause 9. The liquid lubricant composition according to Clause 8, wherein the one or more oil additives are selected from the group consisting of an antioxidant, an antiwear additive, a friction reduction additive, a corrosion inhibitor, a detergent, a metal deactivator, a viscosity modifier, a dispersant, and a combination thereof.

Clause 10. The liquid lubricant composition according to Clause 9, wherein the one or more oil additives comprise an antioxidant, and wherein the antioxidant is selected from the group consisting of (+)-α-tocopherol (TCP), propyl gallate (PG), I-ascorbic acid 6-palmitate (AP), 4,4'-methylenebis(2,6-di-tert-butylphenol) (MBP), butylated hydroxyl anisole (BHA), butylated hydroxyl toluene (BHT), propyl gallate (PG), and tert-butyl hydroquinone (TBHQ).

Clause 11. The liquid lubricant composition according to Clause 9 or Clause 10, wherein the one or more oil additives comprise an antiwear additive, and wherein the antiwear additive is selected from the group consisting of carbon-based materials (graphene, diamond nanoparticles, bucky balls, carbon nanoonions), zinc dithiophosphate (ZDP), zinc dialkyl dithiophosphate (ZDDP), tricresyl phosphate (TCP), dioleoyl phosphite, bis(2-ethylhexyl) phosphate, diphenyl cresyl phosphate, triphenyl phosphorothionate, chlorinated paraffins, glycerol monooleate, and a combination thereof.

Clause 12. The liquid lubricant composition according to any one of Clauses 9-11, wherein the one or more oil additives comprise a corrosion inhibitor, and wherein the corrosion inhibitor is selected from the group consisting of a thiadiazole, a benzotriazole, a tolutriazole, a zinc dithiophosphate, a metal phenolate, a metal sulfonate, a fatty acid, a carboxylic acid, an amine, and a combination thereof.

Clause 13. The liquid lubricant composition according to any one of Clauses 9-12, wherein the one or more oil additives comprise a detergent, and wherein the detergent is selected from the group consisting of a polyisobutylene succinimide, a polyisobutylene amine succinamide, an aliphatic amine, a polyolefin maleic anhydride, and a combination thereof.

Clause 14. The liquid lubricant composition according to any one of Clauses 9-13, wherein the one or more oil additives comprise a metal deactivator, and wherein the metal deactivator is selected from the group consisting of a triazole, a tolyltriazole, a thiadiazole, and a combination thereof.

Clause 15. The liquid lubricant composition according to any one of Clauses 9-14, wherein the one or more oil additives comprise a viscosity modifier, and wherein the viscosity modifier is selected from the group consisting of an ethylene-olefin co-polymer, a maleic anhydride-styrene alternating copolymer, a polymethacrylate, a cellulose, a hydrogenated styrene-butadiene copolymer, a hydrogenated styrene-isoprene copolymer, an ester thereof, and a combination thereof.

Clause 16. The liquid lubricant composition according to any one of Clauses 9-15, wherein the one or more oil additives comprise a dispersant, and wherein the dispersant is selected from the group consisting of succinimide, benzylamine, and a combination thereof.

Clause 17. A lubricant composition comprising a petroleum or a synthetic base oil and about 40% or less by weight of an oil from the seeds of the Brassicaceae *Orychophragmus violaceus.*

Clause 18. A lubricant composition comprising a petroleum or a synthetic base oil and about 40% or less by weight of a liquid lubricant composition according to any one of Clauses 1-16.

Clause 19. A semisolid lubricant composition comprising an emulsion of (i) a thickener and (ii) an oil from the seeds of the Brassicaceae *Orychophragmus violaceus.*

Clause 20. A semisolid lubricant composition comprising an emulsion of (i) a thickener and (ii) a mixture of triacylglycerols of 7,18-diOH $C_{24}$ fatty acids and estolides thereof.

Clause 21. A semisolid lubricant composition comprising an emulsion of (i) a thickener and (ii) an oil from the seeds of the Brassicaceae *Orychophragmus violaceus* that has been esterified with one or more fatty acids.

Clause 22. The semisolid lubricant composition according to Clause 21, wherein the one or more fatty acids are selected from the group consisting of palmitoleic acid, oleic acid, linoleic acid, lauric acid, palmitic acid, stearic acid, and a combination thereof.

Clause 23. A semisolid lubricant composition comprising an emulsion of (i) a thickener and (ii) a mixture of the triacylglycerol [18:2]-[18:2]-[24:1-$(OH)_2$] and estolides thereof.

Clause 24. The semisolid lubricant composition according to Clause 23, wherein the estolides are selected from the group consisting of [18:2]-[18:2]-[24:1-$(OH)_2$-24:2-$(OH)_2$], [18:2]-[18:2]-[24:1-$(OH)_2$-24:2-$(OH)_2$-24:1-$(OH)_2$], [18:2]-[18:2]-[24:1-$(OH)_2$-24:2-$(OH)_2$-24:1-(OH)2-24:1-(OH)2], and a combination thereof.

Clause 25. The semisolid lubricant composition according to Clause 23 or Clause 24, wherein 24:1-$(OH)_2$ has a structure according to the following formula

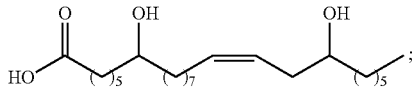

;

and wherein 24:2-$(OH)_2$ has a structure according to the following formula

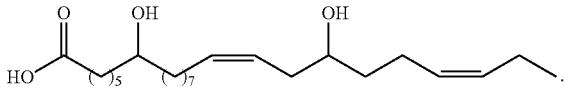

.

Clause 26. The semisolid lubricant composition according to any one of Clauses 19-25, wherein the thickener is selected from the group consisting of a soap such as calcium stearate, cellulose, sodium stearate, lithium stearate, lithium 12-hydroxystearate, and a combination thereof.

Clause 27. The semisolid lubricant composition according to any one of Clauses 19-26, further comprising one or more grease additives.

Clause 28. The semisolid lubricant composition according to Clause 27, wherein the one or more grease additives are selected from the group consisting of an antioxidant, an antiwear additive, a corrosion inhibitor, a detergent, a metal deactivator, a viscosity modifier, a dispersant, and a combination thereof.

Clause 29. The semisolid lubricant composition according to Clause 28, wherein the one or more grease additives comprise an antioxidant, and wherein the antioxidant is selected from the group consisting of (+)-α-tocopherol (TCP), propyl gallate (PG), I-ascorbic acid 6-palmitate (AP), 4,4'-methylenebis(2,6-di-tert-butylphenol) (MBP), butylated hydroxyl anisole (BHA), butylated hydroxyl toluene (BHT), propyl gallate (PG), tert-butyl hydroquinone (TBHQ).

Clause 30. The semisolid lubricant composition according to Clause 28 or Clause 29, wherein the one or more grease additives comprise an antiwear additive, and wherein the antiwear additive is selected from the group consisting of zinc dithiophosphate (ZDP), zinc dialkyl dithiophosphate (ZDDP), tricresyl phosphate (TCP), dioleoyl phosphite, bis(2-ethylhexyl) phosphate, diphenyl cresyl phosphate, triphenyl phosphorothionate, chlorinated paraffins, glycerol mono oleate, and a combination thereof.

Clause 31. The semisolid lubricant composition according to any one of Clauses 28-30, wherein the one or more grease additives comprise a corrosion inhibitor, and wherein the corrosion inhibitor is selected from the group consisting of a thiadiazole, a benzotriazole, a tolutriazole, a zinc dithiophosphate, a metal phenolate, a metal sulfonate, a fatty acid, a carboxylic acid, an amine, and a combination thereof.

Clause 32. The semisolid lubricant composition according to any one of Clauses 28-31, wherein the one or more grease additives comprise a detergent, and wherein the detergent is selected from the group consisting of a polyisobutylene succinimide. A polyisobutylene amine succinamide, an aliphatic amine, a polyolefin maleic anhydrides, and a combination thereof.

Clause 33. The semisolid lubricant composition according to any one of Clauses 28-32, wherein the one or more grease additives comprise a metal deactivator, and wherein the metal deactivator is selected from the group consisting of a triazole, a tolyltriazole, a thiadiazole, and a combination thereof.

Clause 34. The liquid lubricant composition according to any one of Clauses 28-33, wherein the one or more grease additives comprise a viscosity modifier, and wherein the viscosity modifier is selected from the group consisting of an ethylene-olefin co-polymer, a maleic anhydride-styrene alternating copolymer, a polymethacrylate, a hydrogenated styrene-butadiene copolymer, a hydrogenated styrene-isoprene copolymer, an ester thereof, and a combination thereof.

Clause 35. The semisolid lubricant composition according to any one of Clauses 28-34, wherein the one or more grease additives comprise a dispersant, and wherein the dispersant is selected from the group consisting of succinimide, benzylamine, and a combination thereof.

Clause 36. A method of making a lubricant composition according to any one of Clauses 1-35, the method comprising extracting an oil from seeds of a Brassicaceae *Orychophragmus violaceus*.

Clause 37. The method according to Clause 36, wherein the extracting the oil from the seeds comprises mechanically grinding and/or heating the seeds.

Clause 38. The method according to Clause 36 or Clause 37, wherein he extracting the oil from the seeds comprises solvent extraction.

Clause 39. The method according to any one of Clauses 36-38, wherein the extracting the oil from the seed comprises separating a mixture of triacylglycerols of 7,18-OH C:24 fatty acids and estolides thereof.

Clause 40. The method according to any one of Clauses 36-39, further comprising esterification of the oil with one or more fatty acids.

Clause 41. The method according to Clause 40, wherein the one or more fatty acids are selected from the group consisting of palmitoleic acid, oleic acid, linoleic acid, lauric acid, palmitic acid, stearic acid, and a combination thereof.

Clause 42. The method according to any one of Clauses 36-41, further comprising adding or mixing one or more oil or grease additives.

Clause 43. The method according to any one of Clauses 36-42, wherein the lubricating composition is a semisolid lubricating composition, and wherein the method further comprises emulsifying the oil with a thickener.

Clause 44. The method according to Clause 43, wherein the thickener is a soap such as calcium stearate, sodium stearate, lithium stearate, lithium 12-hydroxystearate, and a combination thereof.

We claim:

1. A semisolid lubricant composition comprising an emulsion of (i) a thickener and (ii) a mixture of triacylglycerols of 7,18-diOH $C_{24}$ fatty acids and estolides thereof, wherein a portion of the 7,18-diOH $C_{24}$ fatty acids are esterified with one or more fatty acids are selected from the group consisting of palmitoleic acid, oleic acid, linoleic acid, lauric acid, palmitic acid, stearic acid, and a combination thereof.

2. A semisolid lubricant composition comprising an emulsion of (i) a thickener and (ii) a mixture of the triacylglycerol [18:2]-[18:2]-[24:1-$(OH)_2$] and one or more of the following: [18:2]-[18:2]-[24:1-$(OH)_2$-24:2-$(OH)_2$], [18:2]-[18:2]-[24:1-$(OH)_2$-24:2-$(OH)_2$-24:1$(OH)_2$], [18:2]-[18:2]-[24:1-$(OH)_2$-24:2-$(OH)_2$-24:1-$(OH)_2$-24:1-$(OH)_2$].

3. The semisolid lubricant composition according to claim 2, wherein 24:1-$(OH)_2$ has a structure according to the following formula

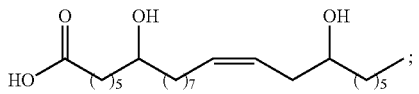

and wherein 24:2-$(OH)_2$ has a structure according to the following formula

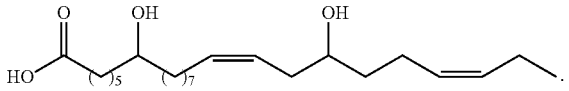

4. The semisolid lubricant composition according to claim 3, wherein the thickener is selected from the group consisting of a soap such as calcium stearate, cellulose, sodium stearate, lithium stearate, lithium 12-hydroxystearate, and a combination thereof.

5. The semisolid lubricant composition according to claim 3, further comprising one or more grease additives.

6. The semisolid lubricant composition according to claim 5, wherein the one or more grease additives are selected from the group consisting of an antioxidant, an antiwear additive, a corrosion inhibitor, a detergent, a metal deactivator, a viscosity modifier, a dispersant, and a combination thereof.

7. The semisolid lubricant composition according to claim 6, wherein the one or more grease additives comprise an antioxidant, and wherein the antioxidant is selected from the group consisting of (+)-α-tocopherol (TCP), propyl gallate (PG), I-ascorbic acid 6-palmitate (AP), 4,4'-methylenebis(2, 6-di-tert-butylphenol) (MBP), butylated hydroxyl anisole (BHA), butylated hydroxyl toluene (BHT), propyl gallate (PG), tent-butyl hydroquinone (TBHQ).

8. The semisolid lubricant composition according to claim 6, wherein the one or more grease additives comprise an antiwear additive, and wherein the antiwear additive is selected from the group consisting of zinc dithiophosphate (ZDP), zinc dialkyl dithiophosphate (ZDDP), tricresyl phosphate (TCP), dioleoyl phosphite, bis(2-ethylhexyl) phosphate, diphenyl cresyl phosphate, triphenyl phosphorothionate, chlorinated paraffins, glycerol monooleate, and a combination thereof.

9. The semisolid lubricant composition according to claim 6, wherein the one or more grease additives comprise a corrosion inhibitor, and wherein the corrosion inhibitor is selected from the group consisting of a thiadiazole, a benzotriazole, a tolutriazole, a zinc dithiophosphate, a metal phenolate, a metal sulfonate, a fatty acid, a carboxylic acid, an amine, and a combination thereof.

10. The semisolid lubricant composition according to claim 6, wherein the one or more grease additives comprise a detergent, and wherein the detergent is selected from the group consisting of a polyisobutylene succinimide. A polyisobutylene amine succinamide, an aliphatic amine, a polyolefin maleic anhydrides, and a combination thereof.

11. The semisolid lubricant composition according to claim 6, wherein the one or more grease additives comprise a metal deactivator, and wherein the metal deactivator is selected from the group consisting of a triazole, a tolyltriazole, a thiadiazole, and a combination thereof.

12. The liquid lubricant composition according to claim 6, wherein the one or more grease additives comprise a viscosity modifier, and wherein the viscosity modifier is selected from the group consisting of an ethylene-olefin co-polymer, a maleic anhydride-styrene alternating copolymer, a polymethacrylate, a hydrogenated styrene-butadiene copolymer, a hydrogenated styrene-isoprene copolymer, an ester thereof, and a combination thereof.

13. The semisolid lubricant composition according to claim 6, wherein the one or more grease additives comprise a dispersant, and wherein the dispersant is selected from the group consisting of succinimide, benzylamine, and a combination thereof.

14. A liquid lubricant composition comprising a mixture of triacylglycerols of 7,18-diOH $C_{24}$ fatty acids and estolides thereof, wherein a portion of the triacylglycerols of 7,18-diOH $C_{24}$ fatty acids are esterified with one or more fatty acids are selected from the group consisting of palmitoleic acid, oleic acid, linoleic acid, lauric acid, palmitic acid, stearic acid, and a combination thereof.

15. The semisolid lubricant composition of claim 3, wherein the ratio of 24:1-$(OH)_2$ to 24:2-$(OH)_2$ (wt/wt) is about 1:3.

16. The semisolid lubricant composition of claim 3, a total amount of 24:1-$(OH)_2$ to 24:2-$(OH)_2$ is about 50% (wt/wt) of the total fatty acid content in the composition.

17. A liquid lubricant composition comprising a mixture of the triacylglycerol [18:2]-[18:2]-[24:1-$(OH)_2$] and one or more of the following: [18:2]-[18:2]-[24:1-$(OH)_2$-24:2-$(OH)_2$], [18:2]-[18:2]-[24:1-$(OH)_2$-24:2-$(OH)_2$-24:1-$(OH)_2$], [18:2]-[18:2]-[24:1-$(OH)_2$-24:2-$(OH)_2$-24:1-$(OH)_2$-24:1-$(OH)_2$].

18. The semisolid lubricant composition according to claim 17, wherein 24:1-$(OH)_2$ has a structure according to the following formula

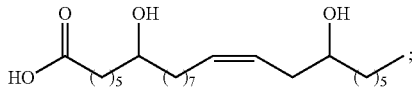

and wherein 24:2-$(OH)_2$ has a structure according to the following formula

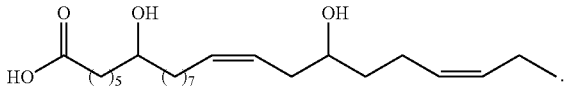

19. The liquid lubricant composition of claim 18, wherein the ratio of 24:1-$(OH)_2$ to 24:2-$(OH)_2$ (wt/wt) is about 1:3.

20. The liquid lubricant composition of claim 18, a total amount of 24:1-$(OH)_2$ to 24:2-$(OH)_2$ is about 50% (wt/wt) of the total fatty acid content in the composition.

* * * * *